United States Patent [19]

Ganucheau, Jr.

[11] 4,419,668

[45] Dec. 6, 1983

[54] COMBINED TONE ONLY AND TONE VOICE MULTIPLE ALERT PAGER

[75] Inventor: Charles J. Ganucheau, Jr., North Lauderdale, Fla.

[73] Assignee: Motorola, Inc., Schaumburg, Ill.

[21] Appl. No.: 305,571

[22] Filed: Sep. 25, 1981

[51] Int. Cl.[3] ..... G08B 5/22

[52] U.S. Cl. ..... 340/825.44; 340/825.48; 455/38

[58] Field of Search ..... 340/825.44, 825.45, 340/825.46, 825.47, 825.48, 311.1; 179/2 EC; 455/31, 36, 38, 352, 228

[56] References Cited

U.S. PATENT DOCUMENTS

| | | | |
|---|---|---|---|
| 3,742,481 | 6/1973 | Nickerson | 340/825.48 |
| 4,019,142 | 4/1977 | Wycoff | 455/38 |
| 4,181,893 | 1/1980 | Ehmke | 340/825.48 |
| 4,249,165 | 2/1981 | Mori | 340/825.44 |

OTHER PUBLICATIONS

Motorola Theory/Maintenance Manual for BPR 2000 Decimal Digital Radio Pager-Feb. 1981.

Motorola Service Manual for BPR 2000 Decimal Digital Radio Pager-Mar. 1981.

*Primary Examiner*—James J. Groody

*Attorney, Agent, or Firm*—James W. Gillman; Phillip H. Melamed; Joseph Downey

[57] ABSTRACT

A combined tone only and tone and voice multiple alert pager is provided which implements separate tone only and tone and voice alert modes in response to the reception of different predetermined signal codes. The pager also includes an audio monitor switch for monitoring audio frequency information received by the pager. During the tone only alert mode the operation of the audio monitor switch is inhibited and only a distinct audible alert tone is provided by the pager. During the tone and voice alert mode, a different audible alert tone is provided and this is automatically followed by audible voice information. Actuation of the audio monitor switch is also utilized to terminate the audible alert tone in the tone only mode whereas actuation has no effect on terminating the audible alert tone in the tone and voice alert mode. Release of manual pressure from the audio monitor switch is utilized to terminate the tone only and tone and voice alert modes but the tone and voice alert mode can only be terminated by operation of the audio monitor switch after the pager starts to provide the subsequent audio frequency information which automatically follows the tone and voice audible alert tone.

15 Claims, 2 Drawing Figures

COMBINED TONE ONLY AND TONE VOICE MULTIPLE ALERT PAGER

BACKGROUND OF THE INVENTION

The present invention generally relates to the field of multiple alert pagers in which reception of various signal codes results in providing in any one of a plurality of different associated alerts. These alerts are used to advise the user (carrier) of the pager to take appropriate action, such as calling his home or office. The present invention more specifically relates to the field of combined tone only and tone and voice pagers in which a tone only alert, consisting only of one or more audible alert tones, or a tone and voice alert, consisting of an initial audible alert tone followed by audible voice signals, are provided in response to the reception of different predetermined signal codes.

Multiple alert paging devices which provide any of several different alerts in response to the reception of different signal codes are known and one such device which is operative to provide audible alerts in response to received sequential tone codes is illustrated in U.S. Pat. No. 4,181,893 to Edward L. Ehmke and assigned to Motorola, Inc. In this multiple alert paging device the reception of a signal code comprising a tone coded preamble followed by five sequential predetermined code tones will result in providing one distinctive audible alert if a unique sixth tone is present after the five code tones and a different alert if this sixth tone is absent. The paging receiver illustrated in the Ehmke U.S. Patent comprises a tone only pager since the only alerts provided consist of various audible alert tones resulting from audio signals generated by an audio oscillator circuit within the pager. In some tone only pagers a switch allowing for selective premature termination of audible alerts has been provided.

In tone and voice pagers a predetermined signal code followed by voice information is received by the pager and the pager responds by providing an audible alert comprising an initial alert tone followed by an audible response corresponding to the received voice information. Typically, such tone and voice pagers are provided with an audio monitor switch which, when actuated, will result in the pager continuously providing audible signals corresponding to audio frequency signals received by the pager. Generally the audio frequency signals received by the pager comprise audio modulation of a carrier signal and may include audio tones which are part of the signal codes. In some tone and voice pagers the audio monitor switch is also utilized to provide for termination of a tone and voice alert mode wherein actuation/deactuation of the switch results in terminating the audible alert, during tone and/or voice portions of the alert, provided by the pager. In some tone and voice pagers switches have been provided which, when actuated, terminate either the audible alert tone or the subsequent voice message, and in some tone and voice pagers termination of the audible alert tone is prohibited until the occurrence of the voice message.

Combined tone only and tone and voice audible alert pagers are known and one such pager is the BPR 2000 Decimal Digital Radio Pager manufactured by Motorola, Inc. In such a combined pager signal codes received by the pager selectively result in implementing either a tone only or a tone and voice mode of audible alert operation. This is desirable since many times it is only necessary to alert the user (carrier) of the pager to the fact that he is being called (paged) whereas in other instances it is necessary to convey additional voice information to the user.

The operation of such combined tone only and tone and voice pagers has not been entirely satisfactory. In the BPR 2000 pager an audio monitor switch is provided which allows the user, if he desires, to continuously monitor received audio information signals. This switch is also utilized to terminate both the tone only and tone and voice alert modes of operation upon release of the switch. This has resulted in allowing undesired modes of operation since by depressing the audio monitor switch after a tone only alert, the user may hear a subsequent voice message which is intended for a different pager and mistakenly conclude that the voice message was intended for him. In addition, premature actuation and release of the audio monitor switch during the tone and voice mode of operation can result in terminating the tone and voice mode during the occurrence of the initial tone and voice audible alert tone thus resulting in the user being unaware that a tone and voice audible alert rather than a tone only audible alert should have been produced by the pager. In essence, prior combined tone only and tone and voice pagers have been inadequate in providing safeguards so that the user of the pager can properly distinguish between tone only and tone and voice alerts despite the occurrence of actuation/deactuation of a manual switch that is used for audio channel monitoring and/or for terminating the tone only and tone and voice alert modes.

SUMMARY OF THE INVENTION

An object of the present invention is to provide an improved combined tone only and tone and voice pager which overcomes the above discussed deficiencies of the prior art.

A more particular object of the present invention is to provide an improved combined tone only and tone and voice pager which has safeguards for enabling the user of the pager to adequately distinguish between tone only and tone and voice audible alerts despite actuation of manual switches on the pager by the pager user.

In one embodiment of the present invention a combined tone only and tone and voice multiple alert pager is provided. This pager comprises a paging receiver that receives signals, searches for predetermined signal codes within these received signals and selectively provides various audible alerts in response to the reception of these predetermined signal codes. The receiver includes an audio transducer for providing these audible alerts, and the receiver has circuitry for providing received audio signals corresponding to audio frequency information received by the receiver. The receiver also includes tone only alert means for implementing a tone only alert mode in response to the receiver receiving a first predetermined signal code, and for providing during said tone only mode, by coupling signals to said audio transducer means, a tone only first audible alert comprising at least a first audible alert tone signal having a first predetermined time duration. The receiver also includes a tone and voice alert means for implementing a tone and voice alert mode in response to said receiver receiving a second predetermined signal code, and for providing during said tone and voice alert mode, by coupling signals to said audio transducer means, a second audible alert comprising at least a second audible alert tone signal having a second predetermined time duration followed by audible signals corresponding to audio frequency information received by said receiver after said second predetermined signal code. The pager includes a switch means coupled to the receiver for normally, in response to actuation/deactuation (actuation and/or deactuation) of the switch means, coupling received audio signals corresponding to the audio frequency information received by the receiver to the audio transducer. The present invention provides for the tone only alert means to include a received audio inhibit means which is enabled in response to the creation of said tone only mode, for inhibiting, during said tone only mode, any coupling of the received audio signals to the audio transducer by actuation of the switch means. The pager also includes means for terminating the tone only mode and the tone and voice mode.

According to the above recited structure, the creation of the tone only mode will result in the audio inhibit means preventing actuation of the switch means from coupling received audio signals to the audio transducer (which preferably comprises a speaker). This means that during the tone only mode user actuation of the switch means will not produce audible information signals that can be mistaken for voice commands intended for a different user when in actuality it was intended that the user receive a tone only page alert.

According to an additional feature of the present invention, the combined tone only and tone and voice pager is provided with a manual switch means (which in actuality corresponds to the audio monitor switch) which when manually actuated during any of the first or second audible alert tones, results in terminating one of these alert tones while permitting the other of the alert tones to persist for a time beyond the actuation of the manual switch means. This feature of the present invention allows the user to more readily identify whether a tone only or a tone and voice alert page has been received since actuation of the manual switch during the existence of an audible alert tone will result in terminating one type of audible alert tone but will not result in terminating the other type of audible alert tone. In the preferred embodiment of present invention, application of manual pressure to the manual switch means causes the manual actuation which results in terminating the audible alert tone associated with the tone only alert.

According to an additional feature of the present invention, structure is provided for preventing the termination of the tone and voice alert mode (and its associated audible alert tone) by actuation of the manual switch until the speaker initially provides the audible signals corresponding to the received audio frequency information. In other words, the manual switch which is used for terminating the tone only and tone and voice modes will not be able to terminate the tone and voice mode unless it is actuated after the occurrence of the tone and voice audible alert tone since at that time the pager will start to provide the received audio frequency information to the user. Thus while the present invention allows the user to terminate this audible audio frequency information by switch actuation, it prevents him from unintentionally terminating the tone and voice mode prior to the occurrence of the audible audio frequency information which follows the tone and voice audible alert tone.

In all of the prior statements of the present invention the term "actuation", unless further modified, should be interpreted as referring to either the actuation or deactuation of a switch, and when referring to a manual switch, the term actuation, by itself, can apply to either the application or release of manual pressure to an actuator of this switch.

It should be noted that while the present invention is described in the terms of a pager having only tone only and tone and voice audible alert modes, the present invention applies to pagers which may provide additional alerts such as graphic visual alerts and/or silent vibratory alerts.

The above features of the present invention, as well as many other advantageous benefits of the invention, are more fully explained subsequently herein.

BRIEF DESCRIPTION OF THE DRAWINGS

For a more complete understanding of the present invention reference should be made to the drawings, in which.

DESCRIPTION OF THE PREFERRED EMBODIMENT

Figure 1:
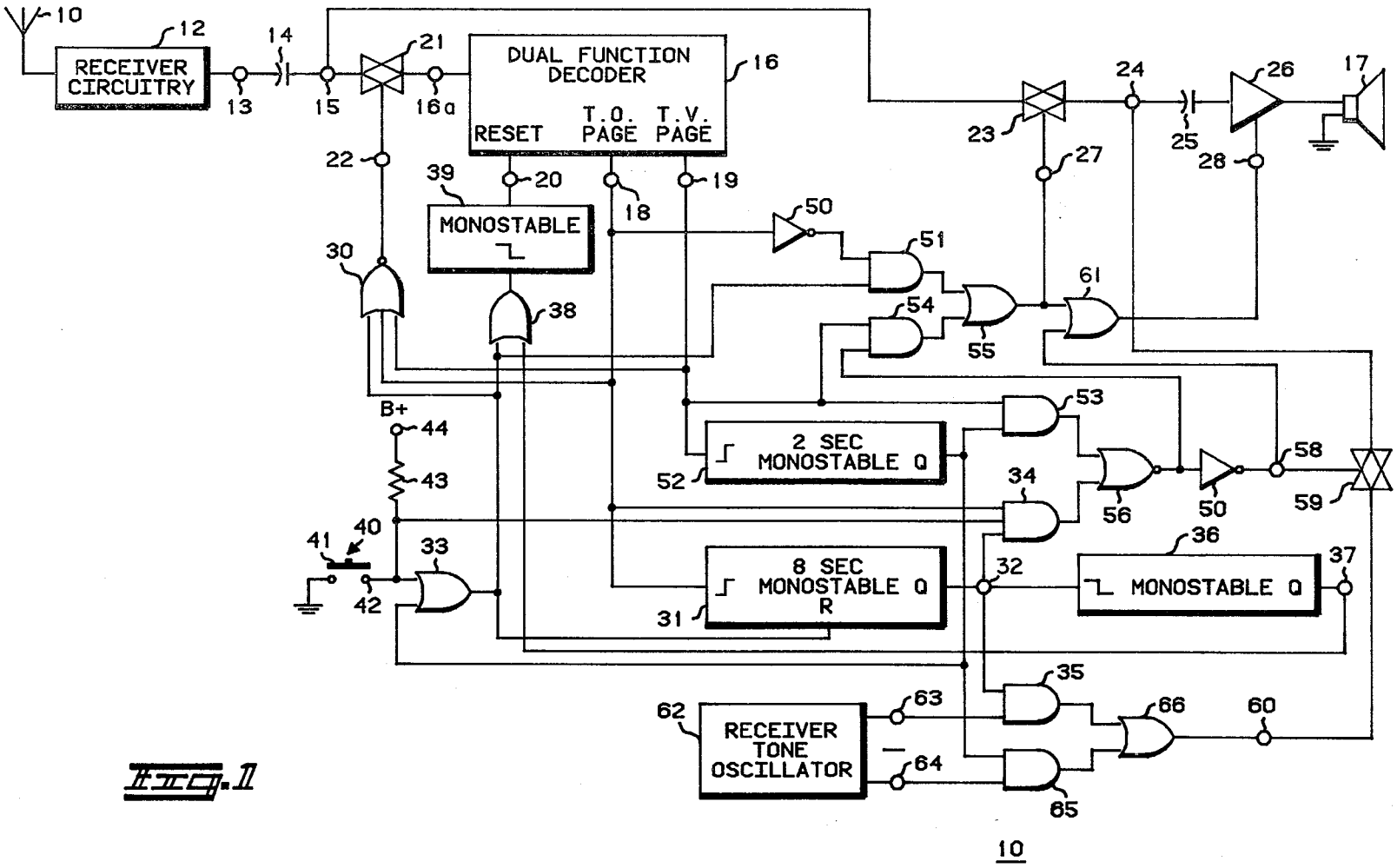
FIG. 1 is a combination block and schematic diagram of a combined tone only and tone and voice multiple alert pager.

FIG. 1 illustrates a combined tone only and tone and voice radio pager 10. The pager includes an antenna 11 for receiving modulated carrier signals with the modulation corresponding to predetermined signal codes which may or may not be followed by audio frequency information. The antenna is coupled to standard receiver circuitry 12 which receives the modulated carrier signals, demodulates them and provides resultant demodulated signals to an output terminal 13 which is coupled via a DC blocking capacitor 14 to a receiver audio output terminal 15. The receiver circuitry 12 comprises standard radio receiver and demodulation circuitry such as mixers, IF stages and demodulators, and the circuitry 12 preferably operates according to standard superheterodyne radio tuning principles. The signals at the terminal 15 correspond to predetermined signal codes which may be followed by voice audio frequency information signals wherein both the signal codes and the audio information signals were used to modulate the received radio carrier signal. Since the construction and operation of the components within the receiver circuitry 12 is well known, no further discussion of the operation of this circuitry is believed necessary.

Essentially, the pager 10 selectively responds to the predetermined code signals provided at the terminal 15 so as to selectively implement either a tone only mode or a tone and voice mode of alert operation. In response to a first predetermined signal code the pager 10 will implement a tone only alert mode wherein a tone only first audible alert comprising at least a first audible alert tone having a first predetermined time duration will be provided by the pager 10. The designation "tone only first audible alert" indicates that only audible tones, rather than received voice information or other audible information, are provided as the first audible alert. During the tone only mode only audible tones are permitted rather than other audible signals such as voice information. The pager 10 will implement a tone and voice alert mode in response to identifing the occurrence of a second predetermined signal code at the terminal 15. In the tone and voice alert mode a second audible alert will be provided which comprises at least an initial second audible alert tone having a second predetermined time duration followed by audible signals which correspond to the audio frequency information, typically a voice message, received by the receiver circuitry 12 after the second predetermined signal code. Basically, the preceding functions are accomplished by the operation of a dual function decoder 16 and a speaker 17 which functions as an audio transducer means. While preferably only an audio speaker 17 is utilized, the present invention also contemplates the use of a transducer for providing the first and second audible alert tones while a separate speaker provides the audible signals which correspond to audio frequency voice information received after a tone and voice signal code. While providing only distinct first and second audible alert tones are discussed herein, providing additional audible alert tones is possible.

As was previously noted, multiple alert pagers are known and in such pagers different alerts are provided in response to the identification of different predetermined signal codes being received. One such multiple alert pager is illustrated in U.S. Pat. No. 4,181,893. That patent describes circuitry which identifies either of two different predetermined signal codes and selectively provides in response thereto either of two different audible alerts depending upon which signal code has been identified. In response to identifying a first signal code a high logic signal is provided on a connecting line X, whereas in response to identifying the second signal code a high logic signal is provided on a connection line Y. Different audible alerts are produced in response to the logic signals on lines X and Y. This generally corresponds to the operation of the dual function decoder 16 illustrated in the present FIG. 1 and therefore precise structural details concerning the circuitry within this decoder will not be described in detail.

In general, the dual function decoder 16 responds to either a first predetermined signal code identifying a tone only alert mode of operation by providing a high logic signal at a tone only (T.O.) page output terminal 18 whereas if the decoder 16 identifies a second predetermined signal code which identifies a tone and voice page a high logic signal is provided at a tone and voice (T. + V.) page output terminal 19. It is contemplated that high logic signals provided at the terminals 18 or 19 will be maintained until the dual function decoder 16 is reset by the application of a high logic signal to a decoder reset terminal 20. The logic states at terminals 18 and 19 will be low prior to any signal code identification by the decoder 16. Since decoders which are resetable and function in accordance with the above description are readily available, further discussion of the construction of the decoder 16 is not believed necessary.

It should be noted that preferably the decoder 16 will identify either of two predetermined signals codes wherein each signal code will correspond to a digital code wherein the code is represented by alternating logic ones and zeros. Such digital decoders are readily available. Preferably the tone only first signal code will correspond to the digital complement of the tone and voice digital code, but this is not necessary for the operation of the present invention. Having the predetermined signal codes correspond to digital codes is also not a necessary limitation of the present invention which would function equally as well with the tone decoder and sequential tone signal codes utilized in U.S. Pat. No. 4,181,893.

The terminal 15 at which the signal codes and receiver audio voice messages are provided is coupled via an electronically controlled gate 21 to an input terminal **16*a* of the decoder 16 so as to selectively permit the decoder 16 to decode the signals at the terminal 15 when the gate 21 is closed which represents the condition of a direct short between the terminal 15 and the input terminal of the decoder 16. A control terminal 22 for the gate 21 is provided and the gate 21 is closed when a high logic signal is provided at the terminal 22, the gate remaining open at all other times. When the gate 21 is open, an open circuit is provided between terminals 15 and 16*a*. The significance of the gate 21** will be further discussed subsequently.

The receiver audio terminal 15 is also coupled through a controllable gate 23 to an audio summing terminal 24 which is coupled via a capacitor 25 to the input of a controllable audio frequency amplifier 26 whose output is directly connected to the speaker 17. The controllable gate 23 is opened or closed in accordance with the logic signals provided at an associated control terminal 27 whereas the operative state of the audio frequency amplifier 26 is controlled in accordance with the logic control signals provided at an associated control terminal 28. For high logic signals at the terminals 27 and 28 the gate 23 will pass audio signals and the audio frequency amplifier 26 will amplify them, whereas for low logic signals at these terminals the gate 23 will block audio frequency signals and the amplifier 26 will not amplify any audio signals applied to its input, respectively. Thus it can be seen that during the voice information portion of the tone and voice audible alert, the gate 23 should allow passage of the audio signals at terminal 15 and the amplifier 26 will amplify these signals such that the speaker 17 will provide audible voice information corresponding to the received audio signals at the terminal 15. For producing other portions of the tone only and tone and voice audible alerts, such as the audible alert tone for the tone only alert or the initial audible alert tone for the tone and voice alert, the gate 23 will block the passage of the audio signals at terminal 15, but the audio frequency amplifier 26 will still be enabled by the signal at the terminal 28 and the amplifier will amplify any other audio signals applied to the summing terminal 24.

The manner in which the decoder output signals at the terminals 18 and 19 selectively implement the tone only and tone and voice audible alerts will now be discussed with regard to logic gate structures shown in FIG. 1 that respond to these signals.

The terminals 18 and 19 are both connected as inputs to a NOR gate 30 which has its output directly connected to the control terminal 22 of the gate 21. These connections insure that once the decoder 16 has identified a predetermined signal code and produced a corresponding alert mode generating signal at one of the terminals 18 or 19, the decoder 16 will be prevented from responding to additional received signal codes until the decoder is reset by a high signal at the terminal 20.

The tone only terminal 18 is also connected directly as an input to a monostable multivibrator 31 which is triggered by the rising edge (positive transition) of logic pulses and provides an output pulse having an 8 second duration at an output terminal 32. Thus in response to the creation of a high logic signal at the terminal 18, the monostable 31 will provide an 8 second high logic output pulse at the terminal 32. The monostable 31 is resetable by logic signals provided to a reset terminal R of the monostable and a NOR gate 33 has its output directly coupled to this terminal R for providing reset signals to the monostable 31. The output of the NOR gate 33 is also coupled as an input to the NOR gate 30. The terminal 32 is coupled as an input to an AND gate 34, an AND gate 35 and a negative transition monostable 36 which provides a 100 milliseconds (ms) high logic output pulse at an output terminal 37 in response to received negative transition (trailing edge) signals. The terminal 37 is directly connected as an input to an OR gate 38 which receives another input via a connection from the output of the NOR gate 33. The output of the OR gate 38 is coupled as an input to a negative transition monostable 39 which functions similarly to the monostable 36 and provides a short duration high logic output signal to the reset terminal 20 in response to negative transition input signals provided by the OR gate 38.

The pager 10 is provided with an audio monitor switch 40 which essentially comprises a manual push-button actuator 41 which, in response to the application of manual pressure to the actuator 41, is displaced and grounds a switch terminal 42 whereas in response to the release of manual pressure from the actuator 41 the terminal 42 resumes its previous voltage potential due spring bias on the actuator 41 causing the actuator to resume its previous position. The terminal 42 is directly connected as an input to both the NOR gate 33 and the AND gate 34, and the terminal 42 is coupled through a resistor 43 to a source of positive potential maintained at a terminal 44. Thus normally the terminal 42 is maintained at a positive potential but in response to the application of manual pressure on the actuator 41, the potential at terminal 42 is reduced to ground potential. The audio monitor switch 40, in response to actuation of this switch, which comprises depressing the actuator 41 to thereby ground the terminal 42, is utilized to couple the receiver audio signals present at the terminal 15 to the speaker 17 when the pager 10 is not in either the tone only or tone and voice alert mode of operation. The audio monitor switch 40 is also utilized to terminate both the tone only and tone and voice alert modes in response to the release of manual pressure from the actuator 41, and the manner in which this is accomplished will be discussed subsequently.

The tone only terminal 18 is coupled through an inverter 50 to an AND gate 51 which receives another input via a direct connection from the output of the NOR gate 33. The terminal 18 is also connected as an input to the AND gate 34. The terminal 19 is directly connected as an input to a 2 second duration monostable circuit 52 which is triggered in response to rising (positive) signal transitions and the output of the monostable 52 is directly connected as an input to both the NOR gate 33 and an AND gate 53. The terminal 19 is also connected as a direct input to the AND gate 53 and as an input to an AND gate 54. The outputs of the AND gates 51 and 54 are both coupled as inputs to an OR gate 55 which has its output directly connected to the control terminal 27 of the gate 23. Similarly, the AND gates 53 and 34 both have their outputs connected as inputs to a NOR gate 56 which has its output directly connected as an input to the AND gate 54 and also connected through an inverter 57 to a control terminal 58 of an electrically controllable gate 59 that is connected between the terminal 24 and an alert tone terminal 60. The terminals 27 and 58 are coupled to and supply two independent inputs to an OR gate 61 which has its output directly connected to the control terminal 28 of the audio frequency amplifier 26. Thus the output of the OR gate 61 will control the enablement of the amplifier 26.

The pager 10 includes a receiver tone oscillator 62 which has a tone only alert tone output terminal 63 and a tone and voice alert tone output terminal 64. The oscillator 62 essentially provides first and second distinctive audio alert tone signals at the terminals 63 and 64 and these signals are selectively gated to the speaker 17 in accordance with whether a tone only or a tone and voice signal code has been identified. Preferably, the tone and voice alert tone signal at the terminal 64 comprises a 2 KHz tone signal which is pulsed at a uniform on/off short duration rate of 8 Hz. This is in contrast to the tone only alert tone signal at the terminal 63 which also comprises a 2 KHz tone but which is non-uniformly pulsed so as to provide for alternate long and short duration 2 KHz pulses wherein the long duration pulse is 5 times the duration of the short duration pulse and the short duration pulses at terminal 63 are equal in duration to the pulses at the terminal 64. This provides for two very distinctive audio alert tone signals which can readily indicate, by their audible difference, whether a tone only or a tone and voice signal code has been received by the pager 10. It should be noted that the construction of the receiver tone oscillator 62 is well within the design capabilities of engineers of average skill in the art and that similar receiver tone oscillators are illustrated in most prior multiple alert pagers wherein it is desired to provide two distinct audible alerts in response to the receipt of either of two different signal codes. It should be noted that the monostables 31 and 52 effectively provide nominal 8 second and 2 second time durations for the tone only and tone and voice audible alert tones.

The terminal 63 is coupled as one input to the AND gate 35 and the terminal 64 is coupled as an input to an AND gate 65 which receives another input via a direct connection to the output of the monostable circuit 52. The outputs of the AND gates 35 and 65 are connected as inputs to an OR gate 66 which has its output directly connected to the terminal 60. By virtue of this configuration, the AND gates 35 and 65 selectively implement which of the alert tone signals at the terminals 63 or 64 will be passed to the alert tone terminal 60 for possible amplification by the audio frequency amplifier 26.

The operation of the pager 10 as shown in FIG. 1 will now be discussed in detail with regard to the flow chart shown in FIG. 2. It should be noted that while the flow chart in FIG. 2 applies to the discrete component implementation of the pager 10 shown in FIG. 1, this flow chart will also apply to a preferred embodiment of the present invention wherein a microprocessor will implement all of the functions of the logic circuits and monostables shown in FIG. 1.

Figure 2A:
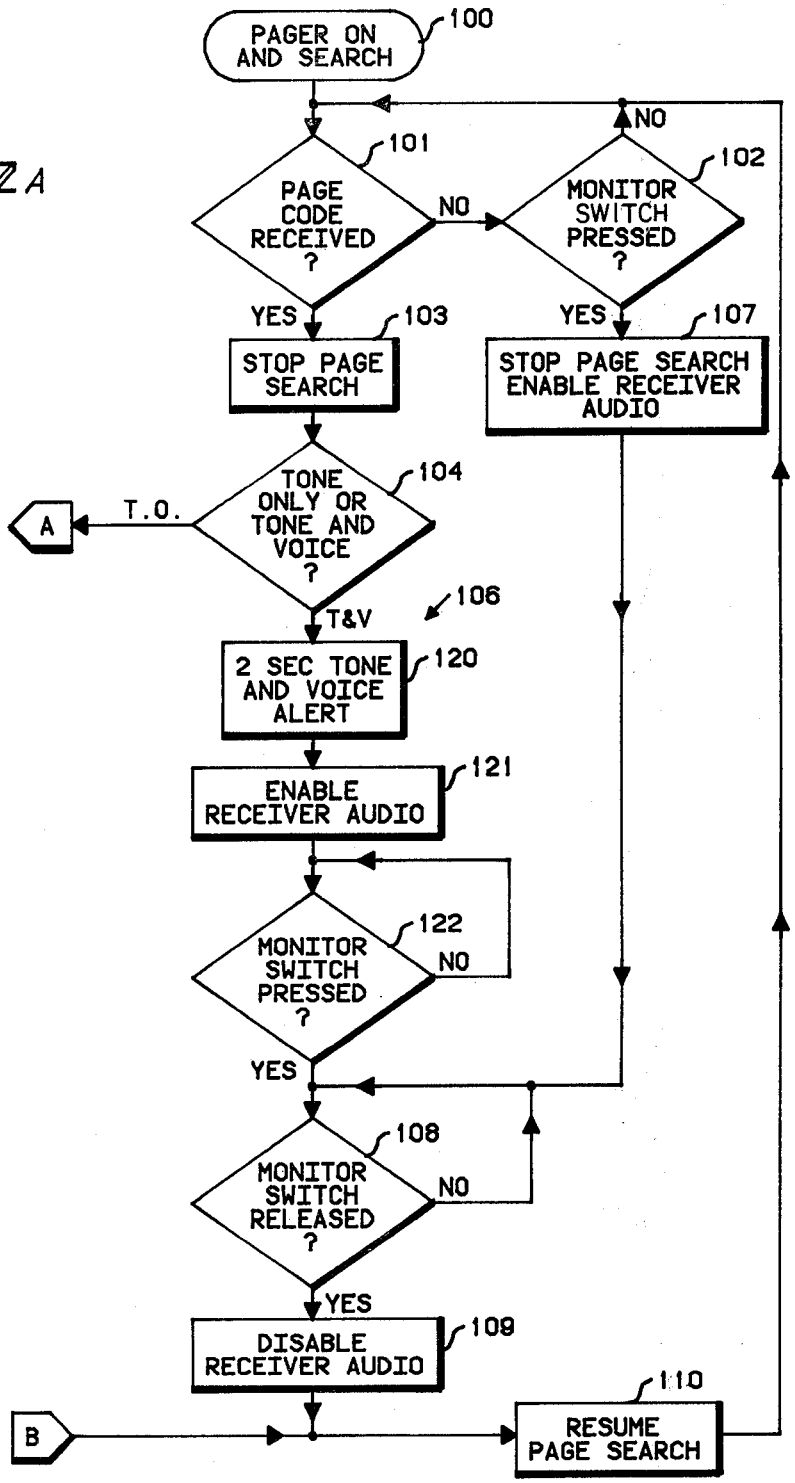
FIG. 2 is a schematic diagram illustrating a flow chart that corresponds to the operation of the pager shown in FIG. 1.
Figure 2B:
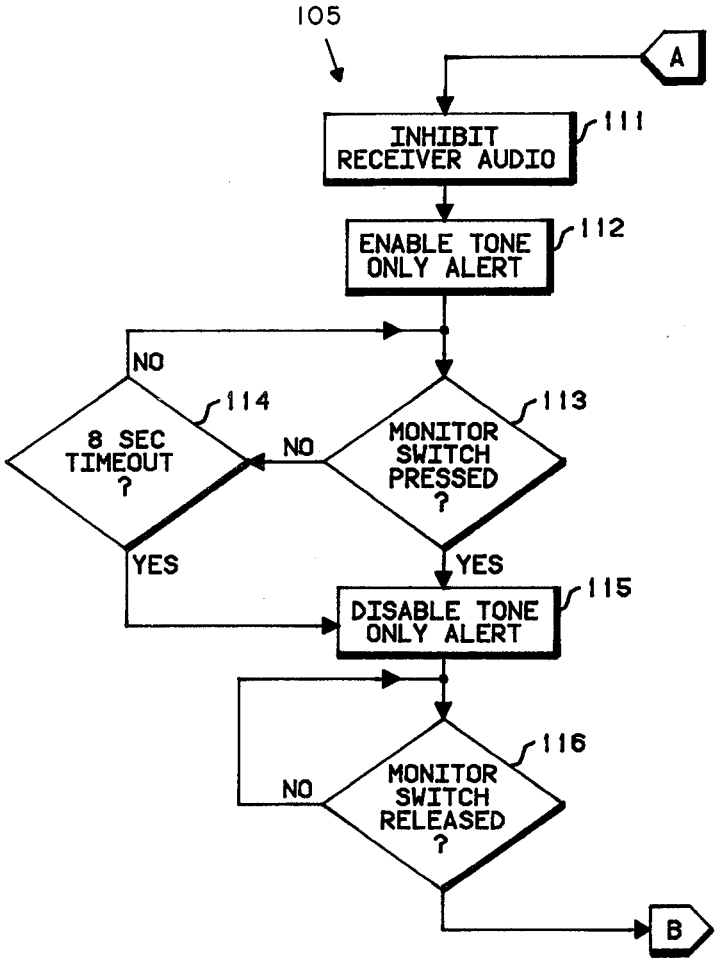

FIG. 2 illustrates a flow chart for either a microprocessor implementation of the present invention or the discrete component implementation of the present invention shown in FIG. 1. In the flow chart, diamond shaped elements correspond to decision blocks for the microprocessor and rectangular blocks represent process steps which are to be implemented by the microprocessor in accordance with the type of decision made by the decision block. Both the decision blocks and process blocks also directly correspond to the operation of the discrete component embodiment shown in FIG. 1.

In FIG. 2, an initializing process block 100 is provided which turns on the pager 10 and implements initial searching for various signal pages (signal codes) which may correspond to a first predetermined signal page that will result in a tone only alert or a second predetermined signal page that will result in a tone and voice alert. The process block 100 essentially corresponds to supplying power to the receiver circuitry 12 and initially providing a control signal to the terminal 22 such that the gate 21 passes the receiver audio signals at the terminal 15 to the input terminal 16*a* of the decoder 16.

After the process block 100, the process flow passes to a decision block 101 which determines whether or not a page (signal code) corresponding to one of two predetermined signal codes has been received. This essentially corresponds to the function of the decoder 16 determining if a predetermined signal code has been received. If no predetermined signal code has been identified by the decoder 16, the process flow passes to a decision block 102 which inquires whether or not a monitor switch which corresponds to the audio monitor switch 40 has been pressed. If the monitor switch has not been actuated (pressed) control then again passes to the decision block 101.

If the decoder 16 indicates that some page has been received, further searching for additional predetermined signal codes is haulted by a process block 103 and a subsequent decision block 104 identifies whether the received page was a tone only page or a tone and voice page wherein this is indicated by the presence of a high logic signal at the terminals 18 or 19. Providing a high logic signal at either of the terminals 18 or 19 will implement either the tone only or tone and voice alert mode and these modes are generally represented by parallel process paths 105 and 106 shown in FIG. 2. It should be noted that functions of the decision blocks 101 and 104 and the process block 103 are actually implemented by the decoder 16 and the NOR gate 30 and the controllable gate 21. Thus when either the tone only or tone and voice signal codes, which are the only signal codes that the decoder 16 will respond to, are identified, then further decoding of subsequent signal codes is inhibited until the decoder 16 is reset.

It should be noted that if the decision block 102 determines that the audio monitor switch 40 was actuated by having manual pressure applied to the actuator 41, this will result in implementing a process block 107 which results in inhibiting the decoder 16 from identifying received signal codes during switch actuation and also results in coupling the receiver audio signals at the terminal 15 to the speaker 17 thereby audibly monitoring the audio frequency information received by the receiver circuit 12. The inhibiting of the decoder 16 in response to the application of manual pressure to the actuator 41 is accomplished by NOR gate 33, in response to the low signal at terminal 42 created during actuation, providing a high logic output signal that results in presenting a low logic signal to the terminal 22 thereby preventing the decoder 16 from receiving the audio signals at the terminal 15. The reason that the NOR gate 33 will respond with a high output logic signal in response to depression of the actuator 41 is that the other input to the NOR gate 33 comes from the monostable 52 which is only actuated during the tone and voice mode whereas the decision block 102 is implemented only when the decoder 16 has not identified a predetermined signal code.

The process block 107 also enables audibly monitoring received audio during the depression of the actuator 41. This is accomplished by the output of the NOR gate 33 providing a high logic signal in response to depressing actuation 41. This logic signal in combination with the high logic signal provided by the inverter 50 indicating the non-existence of a tone only page mode results in the AND gate 51 and OR gate 55 closing the gate 23 and enabling the audio frequency amplifier 26. Thus it can be seen that the switch 40, when neither the tone only or tone and voice alert modes are implemented, does result in providing an audible channel monitoring function for the pager 10.

After implementation of the processed block 107 the process flow proceeds to a decision block 108 which is also contained in the tone and voice alert mode process path 106. The decision block 108 essentially inquires if manual pressure has been released from the actuator 41. If not, the previous mode of operation is maintained as indicated by recirculating the process flow to the input of the decision block 108 if the answer to the decision block 108 question is negative. If manual pressure has been released from the actuator 41, (and it is contemplated that the actuator 41 is spring biased so as to provide for non-grounding of the terminal 42 upon the release of manual pressure), then the process flow from the decision block 108 proceeds to the process block 109 which results in disabling the receiver audio signals from connection to the speaker 17. This is accomplished by reversing the logic state at the output of the NOR gate 33 which thereby causes the gate 23 and amplifier 26 to prevent the passage of received audio signals to the speaker 17.

After the process block 109 the process flow continues to a process block 110 that implements resuming the search for received predetermined signal codes by the decoder 16, and this is implemented by reversing the operative state of the gate 21 in response to the reversal of the logic state produced by the NOR gate 33. After the process block 110 the process flow then proceeds back to the decision block 101 where again the decoder 16 searches for predetermined signal codes received by the antenna 11 and receiver circuitry 12. The process block 110 also terminates any tone only or tone and voice alert by having the monostable 39 reset the decoder 16.

The operation and implementation of the tone only alert mode will now be discussed. If the decoder 16 identifies a received signal code as corresponding to the tone only signal code, a high logic signal is provided at the terminal 18 and this results in implementing a tone only alert mode wherein this corresponds to the decision block 104 channeling the process flow to the tone only alert mode path 105. From the decision block 104, during a tone only alert mode, the process flow passes to a process block 111 which results in inhibiting the speaker 17 from producing audible signals related to the received audio signals at the terminal 15. This is accomplished by the AND gate 51 and the inverter 50 which essentially prevent actuation of the switch 40 from resulting in coupling the received audio signals at the terminal 15 to the speaker 17. This is because in the tone only mode actuation of the switch 40 will now not cause the AND gate 51 to produce a high logic output which would result in coupling the received audio signals to the speaker. This is a primary feature of the present invention since it prevents the user of the pager from hearing any received audio voice information from his speaker during the tone only mode. In prior combined tone only and tone and voice pagers, generally an audio monitor switch was present but actuation of this switch, at any time, would result in providing received audio signals as an input to the speaker. Thus in prior pagers during the tone only mode the user could actuate the audio monitor switch and possibly hear voice instructions intended for other pagers merely because those voice instructions happened to follow a tone only page that was intended for reception by the user's pager. The present invention prevents this extremely undesirable mode of operation.

During the tone only mode of operation, as illustrated by the path 105, the process flow proceeds from the process block 111 to a subsequent process block 112 which results in enabling the production of a distinctive tone only audible alert tone. From the process block 112 the process flow continues to a decision block 113 which inquires if the monitor switch, corresponding to the audio monitor switch 40, has been pressed. If not, the process flow passes to a decision block 114 for inquiry with regard to whether 8 seconds has passed. If the answer to this question is negative, the process flow again cycles to the decision block 113.

The preceeding operation of the components 112 through 114 is implemented by the circuitry in FIG. 1 in the following manner. During a tone only mode of operation, a high logic signal is initially provided at the terminal 18 by the decoder 16 and is maintained until termination of the tone only mode. The production of this high logic signal causes the monostable 31 to produce an 8 second monostable high output pulse. Thus the logic signal at the terminal 32 will remain high for 8 seconds unless the monostable 31 is reset by the NOR gate 33 which is responsive to the actuation of the switch 40. Assuming that the switch 40 has not be actuated, this means that all of the inputs to the AND gate 34 will remain high for 8 seconds resulting in the AND gate 34 providing a high logic signal to the NOR gate 56 which in turn provides a high logic signal at the terminal 58 that results in enabling the audio frequency amplifier 26 and having the gate 59 pass audio tone alert signals from the terminal 60 to the terminal 24. In addition, the signal at the terminal 32 also results in the AND gate 35 passing the tone only alert signal present at the terminal 63 through the OR gate 66 to the terminal 60. The end result is that during the tone only mode, the tone only alert signal at the terminal 63 has passed through the amplifier 26 to the speaker 17 to provide a distinctive audible alert identifying the existence of the tone only alert mode.

In the event that the 8 second period of the monostable 31 expires without premature termination by actuation of the switch 40, this results in providing a low signal at the terminal 32 which thereby prevents the passage of the tone only alert signal at the terminal 63 to the speaker 17 by virtue of the action of the AND gates 34 and 35. This is illustrated in the flow chart in FIG. 2 by having the affirmative answer to the inquiry of the decision block 114 result in routing the process information flow to a process block 115 that results in disabling the tone only audible alert.

It should also be noted that if, during the existence of the tone only mode, the audio monitor switch 40 is actuated by depressing the actuator 41 so as to ground the terminal 42, this will result in immediately resetting the monostable 31 and thereby prematurely terminating the signal at the terminal 32 resulting in the disabling of the tone only alert prior to the expiration of the 8 second period of the monostable. This is indicated in the flow chart in FIG. 2 by having an affirmative response to the decision block 113 result in channeling the process flow to the process block 115.

After the process block 115 the process flow during the tone only mode continues to the decision block 116 which inquires if manual pressure is released (not currently being applied) to the audio monitor actuator 41. If the actuator 41 is being depressed, the information flow merely recycles through the decision block 116. If manual pressure is not currently being applied to the actuator 41, the decision block 116 results in channeling the process flow to the resume page search process block 110 that results in terminating the tone only alert mode and reenabling the decoder 16 to interrogate the audio signals at the terminal 15 to determine if additional pages are being received. This is accomplished, if the actuator 41 has not been depressed during the tone only mode thereby allowing the full 8 seconds for the tone only audible alert tone, by the monostable 36 providing a high logic signal at the terminal 37 in response to the expiration of the 8 second period that results in triggering the monostable 39 to provide a short duration reset pulse at the terminal 20 to reset the decoder 16 thereby forcing the logic signals at the terminals 18 and 19 to zero regardless of their previous value. If the actuator 41 had been depressed during the tone only mode resulting in the premature termination of the 8 second tone only audible alert tone, then the resuming of the effective operation of the decoder 16 would be accomplished in response to either the high to low logic signal transition provided by the NOR gate 33, which occurs when pressure is released from the actuator 41, or the high to low signal transition provided at the termination of the output pulse of the monostable 36, whichever occurs later. This can be better understood by considering that while the decoder 16 will be reset in accordance with the first high to low transition received on either of the inputs to the OR gate 38, if the actuator 41 is being depressed at the time that a high to low transition is provided at the terminal 37, the gate 21 will not allow passage of signals into the decoder 16 until the release of the actuator 41.

From the above description of the tone only alert mode and the process path 105 corresponding to the operation of the tone only alert mode, it should be clear that the present invention provides for inhibiting any received audio being coupled to the speaker by actuation of the switch 40 during the tone only mode. In addition, it is apparant that actuation of the switch 40 during the tone only mode will result in terminating the distinctive tone only audible alert tone if the actuation occurs prior to the existence of 8 seconds of this audible alert signal.

The operation and implementation of the tone and voice mode will now be discussed. If the decision block 104 determines that a tone and voice mode should be implemented in response to the receipt of a predetermined signal code, the process flow from the decision block 104 passes to a process block 120 which implements a fixed duration 2 second distinctive tone and voice audible alert tone. In FIG. 1, when a tone and voice mode is to be implemented, a high logic signal is provided by the decoder 16 at the terminal 19. This results in having the monostable 52 produce a 2 second duration high logic output signal which in turn results in the AND gate 53 producing a high logic output state for 2 seconds that results in enabling the audio frequency amplifier 26 and allowing the gate 59 to pass audio alert tone signals to the speaker 17 from the terminal 60. In addition, the output of the monostable 52, via the AND gate 65, results in providing the distinctive tone and voice audio alert signal at the terminal 64 to the terminal 60. The end result is providing an initial distinctive audible alert tone by the speaker 17 identifying the existence of the tone and voice alert mode wherein the duration of this audible alert tone is 2 seconds.

It is significant to note that actuation of the switch 40 during this 2 second tone and voice audible alert will not terminate this alert. Thus an additional significant feature of the present invention is that during the tone and voice audible alert tone actuation of (applying manual pressure to) the audio monitor switch 40 (which is also used as a reset switch) will not terminate the audible alert tone but actuation of this switch during the tone only audible alert tone will terminate the tone only alert tone. In this manner, the user of the pager, even if he is unsure with regard to whether a tone only or a tone and voice audible alert tone is being generated can verify this fact by manually actuating the audio monitor switch 40. If actuation of the switch results in immediate termination of the audible alert tone, then the audible alert tone that was generated must have been a tone only alert tone since actuation of the switch 40 will have no effect with regard to terminating the tone and voice audible alert tone. This feature of the present inventioh is significant since the user can differentiate between tone only audible alert tones and tone and voice audible alert tones not only by their different distinctive audible characteristics, but also by the fact that one of the audible alert tones will be terminated in response to actuation of the switch 40 whereas the other of these audible alert tones will be unaffected by actuation of the switch 40.

After the process block 120, process flow in the tone and voice process path 106 passes to a process block 121 which results in automatically enabling the speaker 17 to reproduce the audio information present at the terminal 15. This is accomplished by the pager 10 in FIG. 1 providing a high logic signal from the AND gate 54 in response to the termination of the 2 second interval so as to permit the gate 23 to pass audio signals at the terminal 15 to the speaker 17. At the same time during the tone and voice alert mode, the audio frequency amplifier 26 is maintained in an enabled state and the gate 59 will now prevent the passage of the tone and voice audio alert tone signals from the terminal 60 to the terminal 24. Thus the speaker 17 will only produce audible sounds related to the audio information at the terminal 15.

After the initiation of audible sounds by the speaker 17 related to the audio information at the terminal 15, then the present invention, according to the flow chart in FIG. 2, inquires as to whether the actuator 41 of the audio monitor switch 40 is being pressed. This is illustrated by a decision block 122 to which process flow is passed after the process block 121. Without actuation of the switch 40, the decision block 122 results in recycling thereby providing for continuous audio monitoring in the tone and voice alert mode until actuation of the switch 40. Once the actuator 41 of the switch has been depressed, process flow then proceeds to the decision block 108 which inquires, as previously noted, if the actuator 41 has been released. As previously noted, upon release of the actuator 41 the audio information signals at the terminal 15 are effectively disconnected from the speaker 17 by the process block 109 and subsequently the process block 110 results in reseting the decoder 16 so that the pager 10 will resume searching for additional received pages (signal codes). Process block 110 also terminates the tone and voice alert mode by resetting the decoder 11.

An additional significant feature of the present invention is that prior to the production of audio signals at the speaker 17 corresponding to the audio information signals at the terminal 15, application and/or release of manual pressure to the actuator 41 will not result in terminating the tone and voice alert mode of operation. This is significant since in prior combined tone only and tone and voice pagers accidental actuation/deactuation of a manual switch by the pager user could result in terminating the tone and voice alert mode without providing any indication that a tone and voice alert was being generated rather than a tone only alert other than the fact that different initial audible tone signals were used for each alert. This type of operation is extremely undesirable since the user of the pager may assume that since he received no audible audio voice instructions that he must have received a tone only alert and therefore he will respond as if he had received a tone only alert when in actuality he really received a tone and voice alert but due to his inadvertent actuation of the switch, he was prevented from receiving the voice portion of the alert.

The present invention insures that depression of the switch actuator 41 during the occurrence of the tone and voice 2 second audible alert tone will not result in terminating the tone and voice alert mode. Thus, even if the pager user mistakenly depresses the switch actuator 41 during the occurrence of a tone and voice alert audible tone, this will have no effect with regard to terminating the tone and voice audible alert tone or the tone and voice alert mode. This is because there is no way to terminate the 2 second tone and voice audible alert tone by actuation of the switch 40, and because terminating the tone and voice alert mode can only occur by sensing actuation and then deactuation of the switch 40 after the speaker 17 has begun to provide audible signals related to the voice information present at the terminal 15. In this manner, even if the user does prematurely terminate his received voice information signal, during the tone and voice alert mode, he will at least know that he has received a tone and voice page rather than a tone only page. This is beneficial since the reception of a tone only page may call for certain automatic action by the user whereas the reception of the tone and voice page may require different automatic action in addition to any action designated by the voice portion of the page. Thus proper identification of which type of page has been received is extremely important.

The above recited feature of the present invention is implemented by the pager 10 in FIG. 1 automatically connecting the audio signals at the terminal 15 to the speaker 17 upon termination of the output of the 2 second monostable 52. Only subsequent to this occurrence, which coincides with the initial provision of audible signals by the speaker corresponding to the audio frequency information at terminal 15, can actuation of the switch 40 result in resetting the decoder 16, terminating the tone and voice alert mode and blocking the passage of audio signals from the terminal 15 to the speaker 17. All of this is accomplished by the connection of the output of the monostable 52 as an input to the NOR gate 33. This connection effectively masks any actuation of the switch 40 during the tone and voice audible alert tone until after the expiration of the 2 second audible alert tone and the subsequent enablement of the passage audio signals at the terminal 15 to the speaker 17. If desired, a delay or pulse stretcher circuit may be inserted in series with the connection between the output of the monostable 52 and the NOR gate 33 to insure a masking of the switch 40 for a more substantial time after the expiration of the 2 second monostable pulse and the connection of audio signals at terminal 15 to speaker 17. This would insure a longer time of audible voice information before permitting termination of the tone and voice alert mode by the switch 40.

While I have shown and described specific embodiments of this invention, further modifications and improvements will occur to those skilled in the art. Many such modifications are already discussed herein. All such modifications which retain the basic underline principles disclosed and claimed herein are within the scope of this invention.

I claim:

1. A combined tone only and tone and voice multiple alert pager comprising:

paging receiver means for receiving signals and searching for predetermined signal codes in said received signals, said receiver means also providing received audio signals corresponding to audio frequency information received by said receiver means, said receiver means including an audio transducer means for selectively providing various audible alerts in response to the reception of said predetermined signal codes, said receiver means including, tone only alert means for implementing a tone only alert mode in response to said receiver means receiving a first predetermined signal code, and for providing during said tone only mode, by coupling signals to said audio transducer means, a tone only first audible alert comprising at least a first audible alert tone signal having a first predetermined time duration, and tone and voice alert means for implementing a tone and voice alert mode in response to said receiver means receiving a second predetermined signal code, and for providing during said tone and voice mode, by coupling signals to said audio transducer means, a second audible alert comprising at least a second audible alert tone signal having a second predetermined time duration followed by audible signals corresponding to audio frequency information received by said receiver means after said second predetermined signal code;

switch means, separate from said tone only alert means and said tone and voice alert means, coupled to said receiver means for normally, in response to actuation/deactuation of said switch means, coupling said received audio signals corresponding to audio frequency information received by said receiver means to said audio transducer means for audible reproduction thereby; and means for terminating said tone only and tone and voice modes, wherein said tone only alert means includes received audio inhibit means enabled in response to the creation of said tone only mode by the reception of said first predetermined signal code, for inhibiting, during said tone only alert mode, any coupling of said received audio signals to said audio transducer means by said actuation/deactuation of said switch means.

2. A multiple alert pager according to claim 1 wherein said audio frequency information and said first and second predetermined signal codes correspond to modulation of carrier signals received by said receiver means, and wherein said receiver means includes demodulation circuitry to provide said received audio signals.

3. A multiple alert pager according to any of claims 1 or 2 wherein said switch means comprises a manual switch and wherein said actuation/deactuation corresponds to manual actuation/deactuation of said switch means.

4. A multiple alert pager according to claim 3 wherein said mode terminating means includes said manual switch and circuitry, application of manual pressure to said manual switch causing actuation thereof, and subsequent release of said manual pressure from said switch causing termination of said tone only and tone and voice modes.

5. A multiple alert pager according to claim 1 wherein said first and second predetermined time durations are different and wherein said first and second alert tone signals are audibly different from each other.

6. A multiple alert pager according to claim 1 wherein said tone and voice alert means automatically provides said audible signals corresponding to said audio frequency information after said second audible alert tone.

7. A multiple alert pager according to any of claims 1 or 6 wherein manual actuation/deactuation of said switch means terminates each of said tone only and tone and voice alert modes, and which includes means for preventing termination said tone and voice alert mode by said manual actuation/deactuation of said switch means until some time after said audio transducer means initially provides said audible signals corresponding to said audio frequency information.

8. A combined tone only and tone and voice multiple alert pager comprising:

paging receiver means for receiving signals and searching for predetermined signal codes in said received signals, said receiver means also providing received audio signals corresponding to audio frequency information received by said receiver means, said receiver means including an audio transducer means for selectively providing various audible alerts in response to the reception of said predetermined signal codes, said receiver means including, tone only alert means for implementing a tone only alert mode in response to said receiver means receiving a first predetermined signal code, and for providing during said tone only mode, by coupling signals to said audio transducer means, a tone only first audible alert comprising at least a first audible alert tone signal having a first predetermined time duration, and tone and voice alert means for implementing a tone and voice alert mode in response to said receiver means receiving a second predetermined signal code, and for providing during said tone and voice mode, by coupling signals to said audio transducer means, a second audible alert comprising at least a second audible alert tone signal having a second predetermined time duration automatically followed by audible signals corresponding to audio frequency information received by said receiver means after said second predetermined signal code; and manual switch means, when manually actuated/deactuated during one of said first and second audible alert tone signals, substantially immediately terminating said one of said first and second audible alert tone signals, but when manually actuated/deactuated during the other of said first and second audible alert tone signals permitting the other of said first and second audible alert tone signals to exist for a time beyond the actuation/deactuation of said manual switch means, whereby said first and second audible alert tone signals are distinguishable from each other by their response to said manual switch means.

9. A multiple alert pager according to claim 8 wherein application of manual pressure to said manual switch means causes said manual switch actuation thereof, and wherein said multiple alert pager includes reset circuitry responsive to subsequent release of said manual pressure from said manual switch means after actuation thereof for terminating said tone only and tone and voice modes and for resetting said receiver means for searching for additional signal codes.

10. A multiple alert pager according to claim 8 wherein manual actuation/deactuation of said switch means terminates each of said tone only and tone and voice alert modes, and wherein said multiple alert pager includes means for preventing the termination of said tone and voice mode by said actuation/deactuation of said switch means until some time after said audio transducer means initially provides said audible signals corresponding to said audio frequency information.

11. A combined tone only and tone and voice multiple alert pager comprising:

paging receiver means for receiving signals and searching for predetermined signal codes in said received signals, said receiver means also providing received audio signals corresponding to audio frequency information received by said receiver means, said receiver means including an audible transducer means for selectively providing various audio alerts in response to the reception of said predetermined signal codes, said receiver means including, tone only alert means for implementing a tone only alert mode in response to said receiver means receiving a first predetermined signal code, and for providing during said tone only mode, by coupling signals to said audio transducer means, a tone only first audible alert comprising at least a first audible alert tone signal having a first predetermined time duration, and tone and voice alert means for implementing a tone and voice alert mode in response to said receiver means receiving a second predetermined signal code, and for providing during said tone and voice mode, by coupling signals to said audio transducer means, a second audible alert comprising at least a second audible alert tone signal having a second predetermined time duration automatically followed by audible signals corresponding to audio frequency information received by said receiver means after said second predetermined signal code; and a manual switch having an actuator for terminating each of said tone only and tone and voice alert modes in response to actuation/deactuation of said switch actuator; and means for preventing termination of said tone and voice alert mode by said actuation/deactuation of said switch actuator until some time after said audio transducer means initially provides said audible signals corresponding to said audio frequency information.

12. A multiple alert pager according to claim 11 wherein said receiver means includes an audio oscillator that generates first and second alert tone signals which correspond to said first and second audible alert tone signals provided by said receiver means during said tone only and tone and voice alert modes, respectively.

13. A multiple alert pager according to claim 11 wherein said receiver means includes a decoder for identifying the reception of said first and second predetermined signal codes by said receiver means and wherein said multiple alert pager includes means for preventing said decoder from responding to additional received predetermined signal codes during said tone only and tone and voice alert modes.

14. A multiple alert pager according to claim 13 which includes means for preventing said decoder from responding to additional received predetermined signal codes during actuation of said manual switch.

15. A multiple alert pager according to claim 11 wherein said receiver means includes a decoder for identifying the reception of said first and second predetermined signal codes by said receiver means and wherein said multiple alert pager includes means for preventing said decoder from responding to additional received predetermined signal codes during actuation of said manual switch.

* * * * *